US005226608A

United States Patent [19]

Ohashi et al.

[11] Patent Number: 5,226,608

[45] Date of Patent: Jul. 13, 1993

[54] CRADLE DEVICE FOR A YARN WINDING APPARATUS

[75] Inventors: Kenji Ohashi, Uji; Hiroo Otoshima, Shiga; Yasushi Uratani, Ohtsu, all of Japan

[73] Assignee: Murata Kikai Kabushiki Kaisha, Kyoto, Japan

[21] Appl. No.: 806,656

[22] Filed: Dec. 13, 1991

[30] Foreign Application Priority Data

Dec. 17, 1990 [JP] Japan ..... 2-403562[U]

[51] Int. Cl.[5] ..... B65H 54/42

[52] U.S. Cl. ..... 242/18 DD

[58] Field of Search ..... 242/18 DD, 18 R, 129.51

[56] References Cited

U.S. PATENT DOCUMENTS

| | | | |
|---|---|---|---|
| 1,014,836 | 1/1912 | McKean | 242/18 DD |
| 1,347,626 | 7/1920 | Foster | 242/18 DD |
| 1,658,400 | 2/1928 | Swanson | 242/18 DD |
| 3,139,239 | 6/1964 | Perry | 242/18 DD |

FOREIGN PATENT DOCUMENTS

| | | | |
|---|---|---|---|
| 653759 | 12/1937 | Fed. Rep. of Germany | 242/18 DD |
| 920054 | 11/1954 | Fed. Rep. of Germany | 242/18 DD |
| 921916 | 12/1954 | Fed. Rep. of Germany | 242/18 DD |
| 868664 | 5/1961 | United Kingdom | 242/18 DD |

*Primary Examiner*—Stanley N. Gilreath
*Attorney, Agent, or Firm*—Spensley Horn Jubas & Lubitz

[57] ABSTRACT

Even in a case where increased taper winding is carried out by a yarn winding apparatus to form a cone, both end surfaces of a package is formed to be flat. In a cradle device for a yarn winding apparatus a swinging shaft of a cradle holder is inclined to an angle substantially equal to a taper of a conical bobbin with respect to a horizontal plane.

7 Claims, 5 Drawing Sheets

CRADLE DEVICE FOR A YARN WINDING APPARATUS

BACKGROUND OF THE INVENTION

1. Field of the Invention

The present invention relates to a cradle device for holding a bobbin in a yarn winding apparatus of an automatic winder or the like, and particularly relates to a cradle device for holding a bobbin in a yarn winding apparatus for forming a cone.

2. Prior Art

Even in a case where a yarn is wound about a conical bobbin to form a cone, in prior art, there is used a yarn winding apparatus in which a swinging shaft of a cradle holder for supporting a cradle is supported vertically to a casing. The swinging shaft of the cradle holder is inclined with respect to the axis of a winding package.

In a package wound by a conventional yarn winding apparatus in which the swinging shaft of a cradle holder is inclined with respect to the axis of a winding package, the end faces of the yarn package protrude toward the small diameter side of the bobbin. Particularly, as shown in FIG. 4, this tendency is great in a case of carrying out increased taper winding in which an angle of inclination of a bobbin shaft is gradually increased at the rewinding process.

SUMMARY OF THE INVENTION

An object of the present invention is to provide a cradle device for a yarn winding apparatus in which both end surfaces of a package can be formed flat, even when performing increased taper winding to produce a cone.

For achieving the aforesaid object, the preferred embodiment of the present invention includes a cradle device in which a swinging shaft of a cradle holder is inclined in tendency similar to a bobbin shaft at an angle to the same degree as a taper of a conical bobbin with respect to a horizontal plane.

As winding proceeds in the cradle device constructed as described above, the base end of the cradle shaft moves upward substantially perpendicularly to the swinging shaft of a cradle holder, and as the result, the conical bobbin is gradually moved toward the small diameter side. The tendency of the winding position to move toward the small diameter of the bobbin as winding proceeds is reduced.

DETAILED DESCRIPTION OF PREFERRED EMBODIMENT

Figure 1:
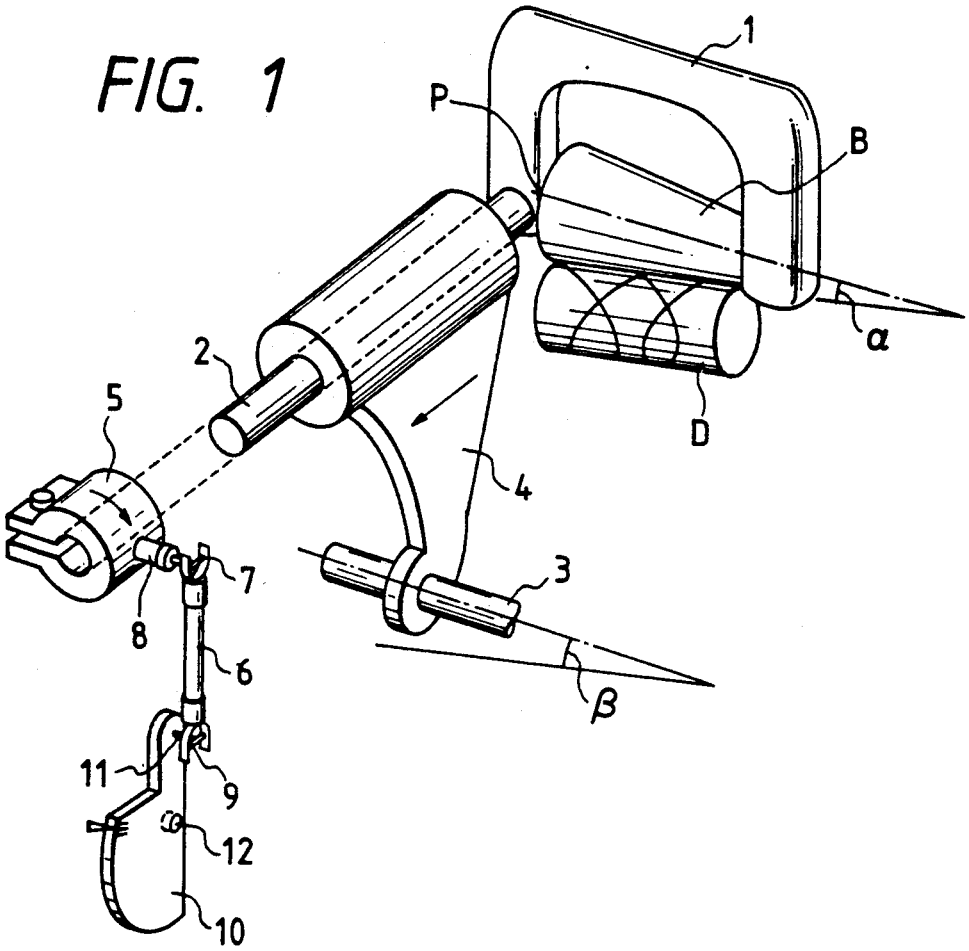
FIG. 1 is a perspective view with a part of a cradle device exploded.

A cradle device for a yarn winding apparatus in accordance with one embodiment of the present invention, capable of performing increased taper winding, will be described with reference to FIGS. 1 to 3.

In this apparatus, a cradle shaft 2 secured to a cradle 1 is made to pivotably extend through a cradle holder 4. The cradle holder 4 may be swingably supported on a swinging shaft 3. A fastener 5 is secured to the other end of the cradle shaft 2, the fastener 5 having an increase lever 6 mounted thereon.

A conical bobbin B is held on the cradle 1 and placed on a rotating traverse drum D. The axis of the conical bobbin B is inclined with respect to a horizontal plane at an angle of $\alpha$.

In prior art, the swinging shaft 3 of the cradle holder 4 is supported in horizontal as previously mentioned. In the present invention, however, the swinging shaft 3 is inclined with respect to the horizontal plane at an angle of inclination $\beta$ which is substantially equal to the angle of inclination $\alpha$ of the conical bobbin B, but can be slightly deviated therefrom.

The increase lever 6 has one end connected through a universal joint 7 to a shaft 8 which is secured to the fastener 5. The other end is connected through a universal joint 9 to a shaft 11 which is secured to an increase bracket 10.

The increase bracket 10 is pivotably supported on a shaft 12 which may be secured to the machine frame. As illustrated in FIG. 2, shaft 11 (and bracket 10) remain fixed during the winding operation. An increased taper can be varied by rotating the increase bracket 10.

The swinging shaft 3 of the cradle holder 4 and the shaft 11 of the increase bracket 10 are depicted a relatively large distance from each other in FIG. 1, but, in practice, the distance may in fact be slight. However, as shown in FIG. 2, the shaft 11 of the increase bracket 10 may be located on the opposite side of the swinging shaft 3 of the cradle holder 4 to effect increased taper winding.

Figure 2:
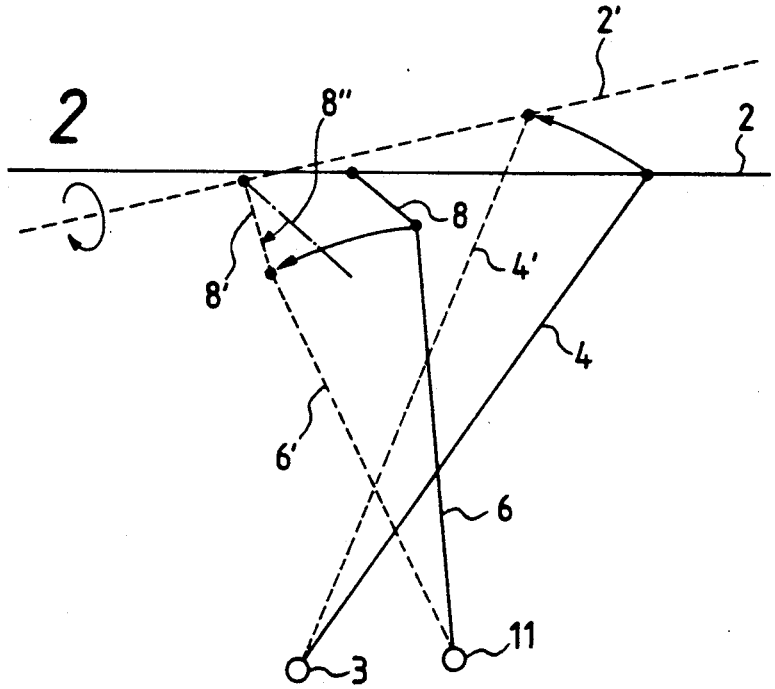
FIG. 2 is a diagram showing the moving state of various parts of the cradle device as winding proceeds.
Figure 3:
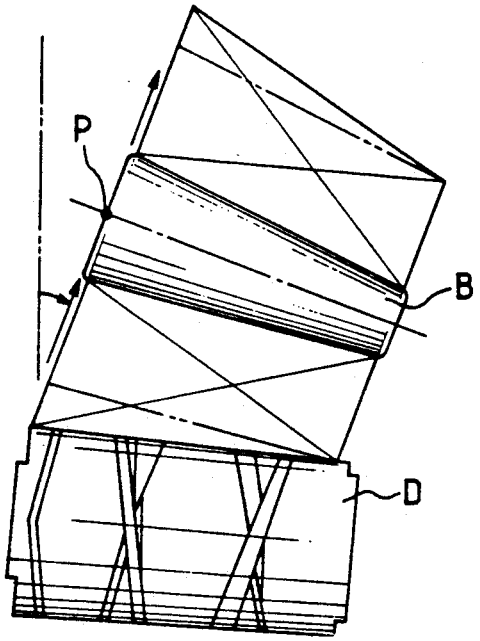
FIG. 3 illustrates formation of a cone by a winding device having a cradle device according to the present invention.

As illustrated for example in FIG. 2, when the winding proceeds and the yarn layer of the conical bobbin B increases, the cradle holder 4 slightly rotates about the swinging shaft 3 in a direction as indicated by the arrow. It is supposed that the cradle holder 4 has rotated to a position 4' as indicated by the dotted line. At this time, the increase lever 6 also rotates to assume a position 6' as indicated by the dotted line. The shaft 8 secured to the cradle shaft 2 through the fastener 5 assumes a position 8' since the length of the increase lever 6 is constant. Since it would assume a position of 8'' indicated by the phantom line if the increase lever 6 was not present, the shaft 8 has moved to a position of 8' from the position of 8''. As a result, the cradle shaft 2 is rotated in a direction of the arrow when the former moves to the position of 2'. In other words, as the winding proceeds, the axis of the conical bobbin B gradually increases its angle of inclination to effect the increased taper winding.

Figure 4:
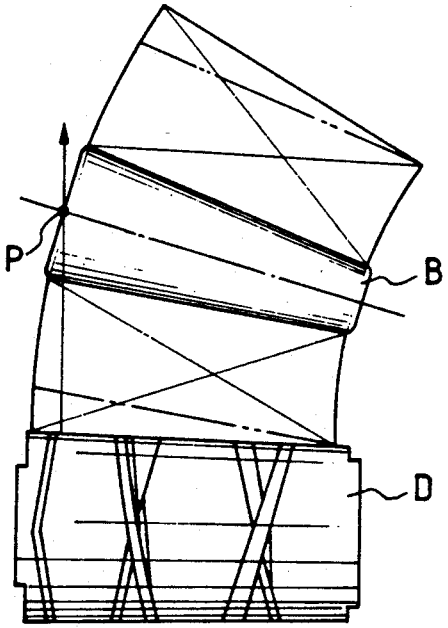
FIG. 4 PRIOR ART
FIG. 4 illustrates formation of a cone by a winding device having a cradle device according to prior art.

Moreover, since the angle of inclination of the swinging shaft 3 of the cradle holder 4 is substantially equal to the angle of inclination of the conical bobbin B, the cradle shaft 2 rotates in a direction of the arrow shown in FIG. 2 as the winding proceeds. Accordingly, the diameter of the cone increases but the up locus of the base end of the cradle shaft 2 is perpendicular to the swinging shaft 3. Thus, the moving locus of an intersection P between the axis of the conical bobbin B and the end of the large-diameter portion is a straight line substantially perpendicular to the swinging shaft 3, as shown in FIG. 3. In this respect, the aforesaid moving locus is greatly different from that of prior art which rises vertically to the horizontal plane, as shown in FIG. 4. In other words, when the swinging shaft 3 is not inclined, the locus of the point P is as indicated by the contour line in FIG. 4. However, when the swinging shaft 3 is inclined as in the present invention, it is inclined with respect to the contour line. Such inclination of the moving locus of the point P reduces the tendency of the winding position to move toward the small diameter portion of the bobbin as the winding proceeds. Accordingly, this is also true for the ordinary winding as well as the increased taper winding.

The present invention being constructed as described above, there are effects described below.

Even in the case where a cone is formed by carrying out the increased taper winding, both end surfaces of the package can be formed to be flat, and therefore, thereafter handling and packing of packages becomes easy, and a damage given to the packages can be prevented.

Furthermore, a cone package of the present invention and a conventional cone package will be illustrated hereinafter in detail.

Figure 6:
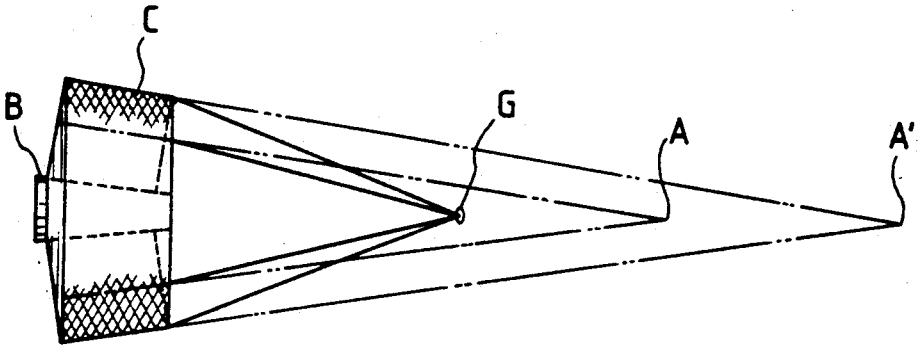
FIG. 6 PRIOR ART
FIG. 6 is a side view of a conventional cone.
Figure 8:
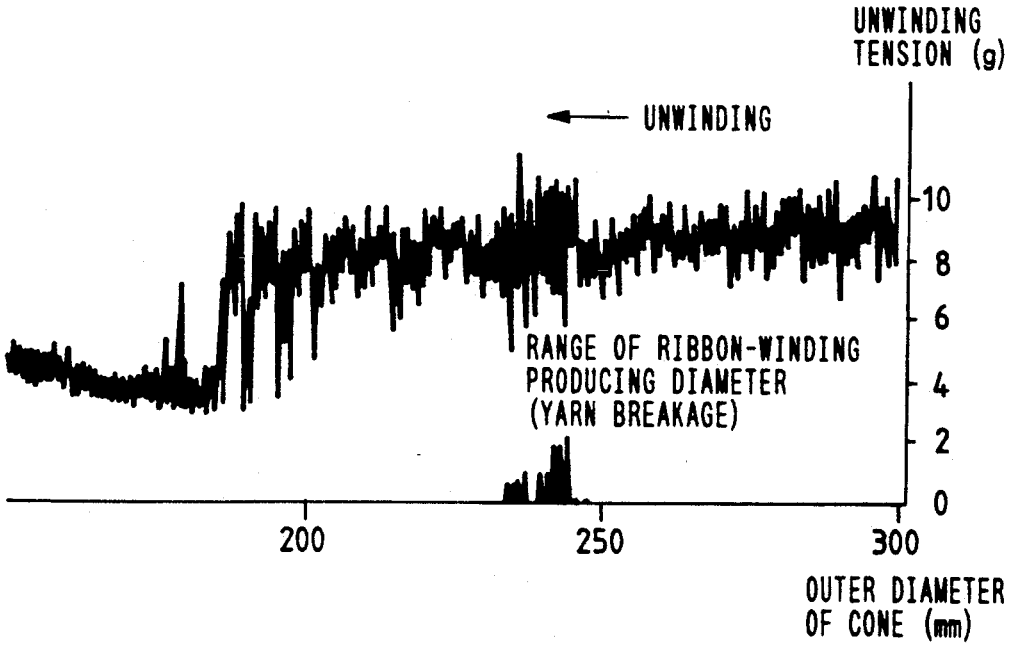
FIG. 8 PRIOR ART
FIG. 8 is a graph illustrating the relation between an outer diameter of a cone and unwinding tension when a conventional cone is unwound.

A cop (spinning bobbin) produced by a spinning frame is rewound by a winder to produce a increased taper winding cone C, for example, having a yarn layer of width 6 inches, outer diameter at large diameter side 20 mm, and angle of cone surface 7.5° wound on a conical bobbin B of the angle of cone 5°57′, as shown in FIG. 6. If the cone C is used to feed a weft yarn to a high-speed weaving machine, a yarn is fed to the weaving machine side being passed through a yarn guide which is located at the position about 40 cm away from the end face at the small diameter side of the cone C. An intersection point A of extension lines of peripheral surface of the cone C, however, exists further 68 cm far from the yarn guide G. When the cone C is one having a yarn layer of which an outer diameter at large diameter side is 300 mm, an intersection point A′ of extension lines of peripheral surface of the cone C exists further away from the point A. Accordingly, a yarn is unwound being rubbed with a yarn of the peripheral surface of the cone C without ballooning as shown in FIG. 6. Thus, the unwinding tension becomes to be larger and the variation of the unwinding tension is much great as shown in FIG. 8 so that the yarn is fuzzed by the rubbing and a yarn breakage occurs in the diameter range where a ribbon winding is produced. Actually, the large cone is rewound again to a small cone having a width of 3 inches to feed a weft yarn to a high-speed weaving machine.

Conventionally, in order to feed a weft yarn to a high-speed weaving machine, a rewinding process should be repeated two times from production of cops and a yarn amount wound on a cone having a width of 3 inches is not so much. While, an end face at a small diameter side of an increased taper winding cone C rewound from a cop is not flat and is raised as close as to the outer peripheral layer since the yarn is wound on a conical bobbin B. In actual case, in consideration of an unwinding property of the wound yarn, the end face is formed to be further raised than a raising degree theoretically obtained. So, when a diameter of a cone C becomes large to a certain extent, an edge portion of an end face at a small diameter side of the cone is raised over an end portion of a conical bobbin B and the edge portion of the cone C is damaged on packing and transportation of the cone.

The present invention provides a number of advantages including winding cone of increased taper which is adapted to unwind easily to facilitate the feeding of weft yarn to a high-speed weaving machine. Additionally, the cone has a great amount of yarn and the edge portion of the cone is unlikely to be damaged during packing and transportation. The cone of the present invention is so formed to have increased taper winding as apex of a virtual circular cone extended from an outer peripheral surface of a cone in each winding diameter thereof is gathered substantially at one point and an end face of the cone at a small diameter side is formed to be flat. The cone of the present invention is so formed to have increased taper winding as an apex of a virtual circular cone extended from an outer peripheral surface of a cone in each winding diameter is positioned nearer to the cone than a yarn guide when the cone is set in a weaving machine to feed a weft yarn, and an end face of the cone at a small diameter side is formed to be flat. The cone is wound to have a surface angle more than 9° around a conical bobbin having cone angle less than 5°57′ and an end face of the cone at a small diameter side is formed to be flat.

If the cone so constituted as mentioned above is set in a high-speed weaving machine and the yarn is unwound from the cone, the yarn is unwound forming a ballooning directly from the peripheral face of the cone without rubbing therewith since the apex of the virtual circular cone extended from the outer peripheral face of the cone is always positioned near to the cone than a yarn guide. Additionally, the problems caused when only an edge portion of the cone abuts a partition plate during packing and transportation be eliminated.

Embodiments of cone of the present invention will be illustrated referring to FIGS. 5, 7, 8 and 9.

Figure 5:
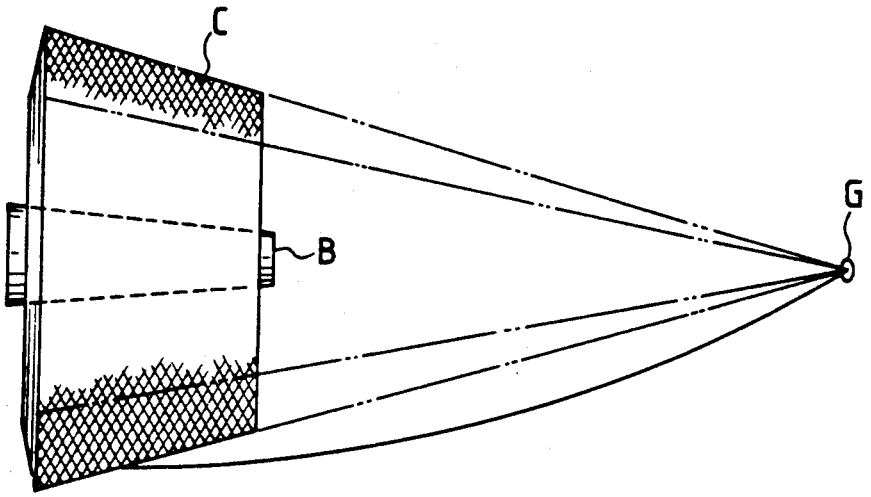
FIG. 5 is a side view of a cone of the present invention.

The cone C is formed by applying a conical bobbin B of cone angle 5°57′ for a cone of 6 inches, which is generally used at present, and by winding a yarn on the conical bobbin B to form an increased taper winding having a larger angle than the conventional one. That is, the increasing amount of surface angle of cone which is increased relative to the increase of winding diameter is made larger than the conventional one and the surface angle of the cone is finally set larger than 9°15′. As shown in FIG. 5, the surface angle of the cone should be set such a large angle in order that the extension lines of the surface of the cone (an apex of a virtual circular cone) are gathered at a position of a yarn guide G or at a position nearer than the guide G of a weaving machine and the like in each diameter of the cone. The apexes of the virtual circular cone may be distributed in a range nearer than the yarn guide G other than the case the apexes of the virtual circular cone are gathered at one point. However, if the apex of the virtual circular cone is positioned unnecessarily near to the cone, it is not desirable because an amount of wound yarn is decreased. Incidentally, even in the cone of the present invention, the apex of the virtual circular cone derived from the peripheral surface of the cone is deviated toward the cone C on start of the winding operation. It, however, does not give any inconvenience.

The cone C is wound to have a flat end face at the small diameter side thereof though the increased taper winding of large angle is done as mentioned above. According to the formation of flat end face, the edge portion of the cone is not damaged compared with the conventional cone when the cones are stacked in plural stages using partition plates and packed, or the cones are transported by palletized packing whereby cones are directly stacked on a pallet as widely done in Western countries.

Figure 7:
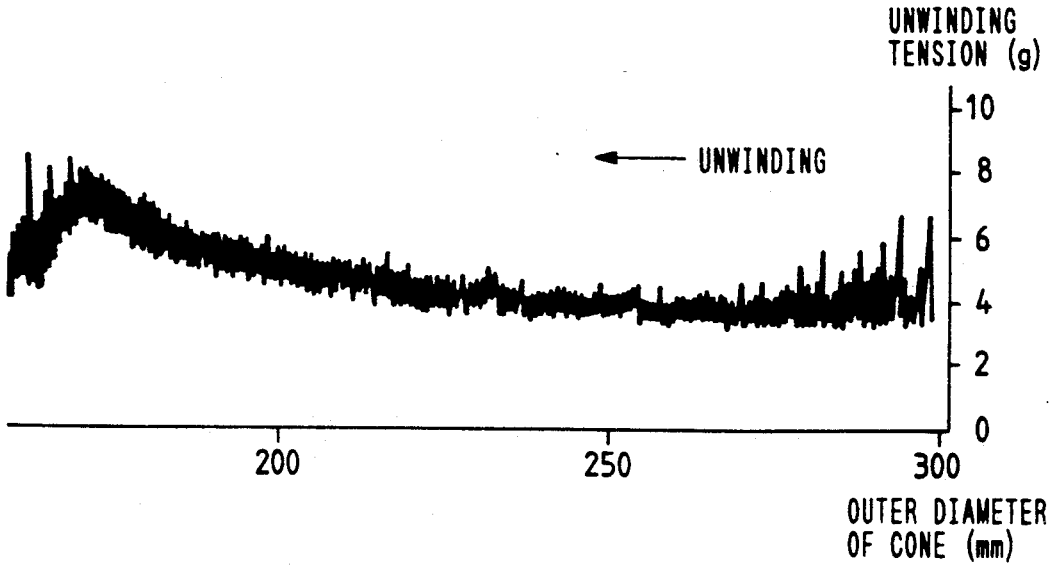
FIG. 7 is a graph illustrating the relation between an outer diameter of a cone and unwinding tension when a cone of the present invention is unwound.

When the cone C having the figure as mentioned above is unwound at high speed in a weaving machine, there is apparent difference in occurrence of fuzz on the yarn surface of the cone compared with the conventional cone. As shown by the solid line in FIG. 6, the yarn is unwound from the conventional cone C rubbing the surface thereof without ballooning almostly. Specially, in the vicinity of the range of ribbon-winding producing diameter, the occurrence of fuzz due to the rubbing causes a large fluctuation in tension and it is main factor of breakage of a weft yarn due to unabling of unwinding and breakage of a weft yarn due to cone-sloughing. The yarn breakage occurs some times as disclosed in FIG. 8. While, the yarn is unwound from the cone C of the present invention ballooning directly from the surface thereof as shown by a solid line in FIG. 5 and the unwinding tension does not change abnormally even in the range of winding diameter including outer diameter of cone 245 mm corresponding to the ribbon-winding producing diameter. The level of mean value of unwinding tension of the cone of the present invention is lowered compared with the level of that of the conventional cone shown in FIG. 8. As the result of these experimental data, it is enough the obtain a cone of the present invention that the apexes of the virtual circular cone derived from the peripheral surface of the cone in the diameter range larger than the ribbon-winding producing diameter appeared at first are gathered at one point which is nearer to the cone than the yarn guide. The data shown in FIGS. 7 and 8 are obtained by winding up a carded cotton yarn of Ne 40 using a traverse drum having wind number 2.5 to produce a cone and by unwinding the cone at a speed of 1200 m/min.

Figure 9:
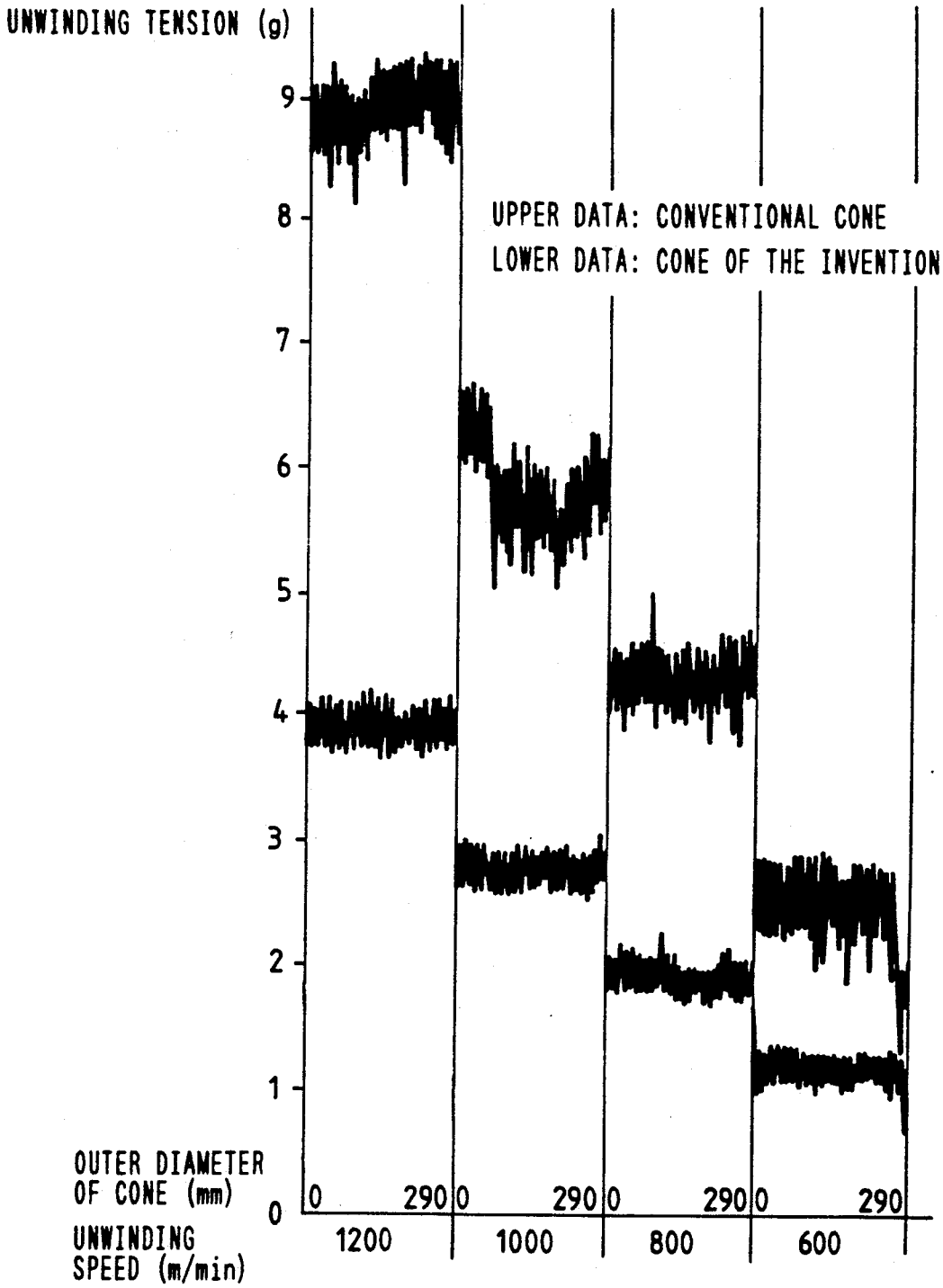
FIG. 9 is a graph illustrating the relation between an unwinding speed and an unwinding tension of a cone of the present invention and a conventional cone, respectively.

The relation between the unwinding tension of the conventional cone and the cone of the present invention are experimented when the distance between the end face of the cone C at the small diameter side to the yarn guide G are set to be 350 mm and the unwinding speed is varied from 600–1200 m/min. are shown in FIG. 9. The variation of unwinding tension of the conventional cone is shown in upper part of the graph and the variation of unwinding tension of the cone of the present invention is shown in lower part of the graph. Regarding the conventional cone, the unwinding tension is rapidly increased in response to the increase of the unwinding speed of the cone. While, regarding the cone of the present invention, the unwinding tension is merely increased in proportion to the increase of the unwinding speed. Moreover, the unwinding tension of the cone of the present invention at the unwinding speed 1200 m/min is smaller than the unwinding tension of the conventional cone at the unwinding speed 800 m/min.

The present invention has effects as described hereinafter since it is constituted as mentioned above.

That is, the fuzzing on the outer peripheral surface of cone is apparently decreased in comparison with the conventional cone and abnormal variation of unwinding tension of a yarn does not occur even in the ribbon-winding producing diameter range. The mean value of unwinding tension is remarkably decreased and there is few yarn breakage on unwinding operation. These effects become more apparent as the unwinding speed of cone is increased. Accordingly, the cone having a large amount of yarn and obtained in a winder by rewinding a spinning bobbin can be supplied to feed a yarn to a high-speed weaving machine without step of rewinding again. The damage of the edge portion of the cone on packing and on transportation may be prevented.

Furthermore, there are many effects such as a reduction in yarn being released at a position away from the package surface during winding, often referred to as off lease winding or traverse miss, when the cone is wound by a winder, the distribution of the solidity of surface of the cone becomes even, deformation of the cone after steam setting to prevent kink is avoided, etc.

What is claimed is:

1. A cradle device for use with a winding apparatus, the winding apparatus including a drum defining a drum axis, the cradle device comprising:

a cradle adapted to support a bobbin, the bobbin defining a bobbin axis, the drum axis and the bobbin axis defining an angle greater than zero, a swinging shaft defining a swinging axis, the drum axis and the swinging axis defining an angle greater than zero, connecting means for connecting the cradle and the swinging shaft, and rotating means for rotating the cradle in order to increase the angle defined by the drum axis and the bobbin axis as the cradle moves away from the drum, whereby the cradle moves away from the drum along a path defining a substantially straight line perpendicular to the swinging axis.

2. The device of claim 1, wherein angle defined by the drum axis and the swinging axis is substantially equal to the angle defined by the drum axis and the bobbin axis.

3. The device of claim 1, wherein the connecting means comprises a cradle shaft operably connected to the cradle and a cradle holder operably connected to the swinging shaft, and the cradle shaft is slidably coupled to the cradle holder.

4. The device of claim 3, wherein the cradle shaft defines a first end and a second end, the first end of the cradle shaft is operably connected to the cradle, and the rotating means comprises an increase lever operably connected to the second end of the cradle shaft.

5. The device of claim 4, wherein the increase lever defines a first end and a second end, the first end of the increase lever is operably connected to the second end of the cradle shaft, and the rotating means further comprises an increase bracket operably connected to the second end of the increase lever.

6. The device of claim 5, wherein a first universal joint connects the increase bracket with the second end of the increase lever and a second universal joint connects the second end of the cradle shaft to the first end of the increase lever.

7. The device of claim 5, wherein the increase bracket is pivotably supported on a bracket shaft, the bracket shaft in spaced relation to the swinging shaft.

* * * * *